US006298754B1

(12) United States Patent
Brown

(10) Patent No.: US 6,298,754 B1
(45) Date of Patent: Oct. 9, 2001

(54) WRENCH FOR FIREFIGHTERS

(76) Inventor: Donald J. Brown, 48 Parkway Dr., Westbury, NY (US) 11590

( * ) Notice: Subject to any disclaimer, the term of this patent is extended or adjusted under 35 U.S.C. 154(b) by 0 days.

(21) Appl. No.: 09/426,026

(22) Filed: Oct. 25, 1999

(51) Int. Cl.[7] ..... B25B 13/00

(52) U.S. Cl. ..... 81/125.1; 7/138; 81/167; 81/176.2

(58) Field of Search ..... 7/138, 139; 81/125.1, 81/167, 176.2

(56) References Cited

U.S. PATENT DOCUMENTS

| | | | | |
|---|---|---|---|---|
| D. 263,674 | | 4/1982 | Ebert . | |
| 1,400,285 | | 12/1921 | Hart . | |
| 1,413,798 | * | 4/1922 | Shinn | 7/139 X |
| 1,465,009 | | 8/1923 | Wasseth . | |
| 1,727,623 | | 9/1929 | Thewes . | |
| 1,763,353 | | 6/1930 | Heller . | |
| 4,903,555 | | 2/1990 | Howard . | |
| 5,247,715 | | 9/1993 | Nishiguchi . | |
| 5,428,853 | * | 7/1995 | Menke et al. | 7/138 |
| 5,432,968 | * | 7/1995 | Beck | 7/138 X |

FOREIGN PATENT DOCUMENTS

| | | | | |
|---|---|---|---|---|
| 12484 | * | 6/1904 | (GB) | 7/139 |

* cited by examiner

*Primary Examiner*—James G. Smith
(74) *Attorney, Agent, or Firm*—Law Office of Leo Zucker

(57) ABSTRACT

A wrench tool suitable for use by firefighting personnel. The tool has an elongated handle, and a spanner part at a first end of the handle. The spanner part has a projecting claw for operatively engaging a pin on the circumference of a pipe or a hose coupling ring to be rotated by the tool. A wrench part, at a second end of the tool handle opposite the first end, has jaws arranged for adjustable relative movement to grip an object to be turned by the tool. The range of movement of the jaws includes a position at which the jaws are set to receive and safely grip an outside levering tool for producing increased leverage when operating the spanner part of the tool.

3 Claims, 1 Drawing Sheet

WRENCH FOR FIREFIGHTERS

BACKGROUND OF THE INVENTION

1. Field of the Invention

This invention relates to hand tools, and particularly to tools for use by firefighting personnel.

2. Discussion of the Known Art

Tool bags carried by firefighting personnel typically include, among other things, a conventional adjustable pipe wrench for operating rusty or stuck water valve stems at the site of a fire; and a spanner wrench for loosening or tightening pipe caps and hose coupling rings by engaging circumferentially arranged pins on such caps or rings.

When a conventional spanner wrench encounters a "stubborn" cap or ring, another tool such as a hammer is often used to strike a blow against the free end of the spanner, in an attempt to break loose the frozen cap or ring. Such misuse of the spanner wrench can cause it eventually to fracture or otherwise fail during normal use.

U.S. Pat. Nos. 1,763,353 (Jun. 10, 1930) and 5,247,715 (Sep. 28, 1993) show tools intended for use by firemen. The tool of the '353 patent has a handle portion with a spring-biased swinging jaw at one end for clamping about a pentagonal valve stem. An arcuate surface formed on the other end of the handle portion has a socket and aperture for engaging a pin of a hose coupling ring. The tool of the '715 patent has an adjustable spanner head at one end of the tool handle for engaging fire apparatus couplings of different diameters. A wedged tip at the opposite end of the handle is used for prying.

There remains a need for a tool that can be carried conveniently by firefighters, and which tool can operate safely both as a wrench and as a spanner even when assisted by an outside pry bar or other levering device.

SUMMARY OF THE INVENTION

According to the invention, a wrench tool includes an elongated tool handle having a handle axis. A spanner part at a first end of the tool handle is formed with an offset to one side of the handle axis, and a claw projects from a free end of the spanner part in a direction approximately perpendicular to the handle axis for operatively engaging a pin on the circumference of a cap or coupling ring to be worked by the tool. A wrench part at a second end of the tool handle opposite the first end, has jaws constructed and arranged for adjustable movement along the general direction of the handle axis over a certain range, for operatively engaging an object to be worked by the tool. The range of movement of the jaws includes a position at which the jaws are set to receive an outside levering tool for obtaining increased leverage when operating the spanner part.

In the disclosed embodiment, the jaws of the wrench part open in a direction that is opposite to the direction in which the claw of the spanner part projects, for supporting the outside levering tool safely when producing added torque at the spanner part of the tool.

For a better understanding of the invention, reference is made to the following description taken in conjunction with the accompanying drawing and the appended claims.

DETAILED DESCRIPTION OF THE INVENTION

Figure 1:
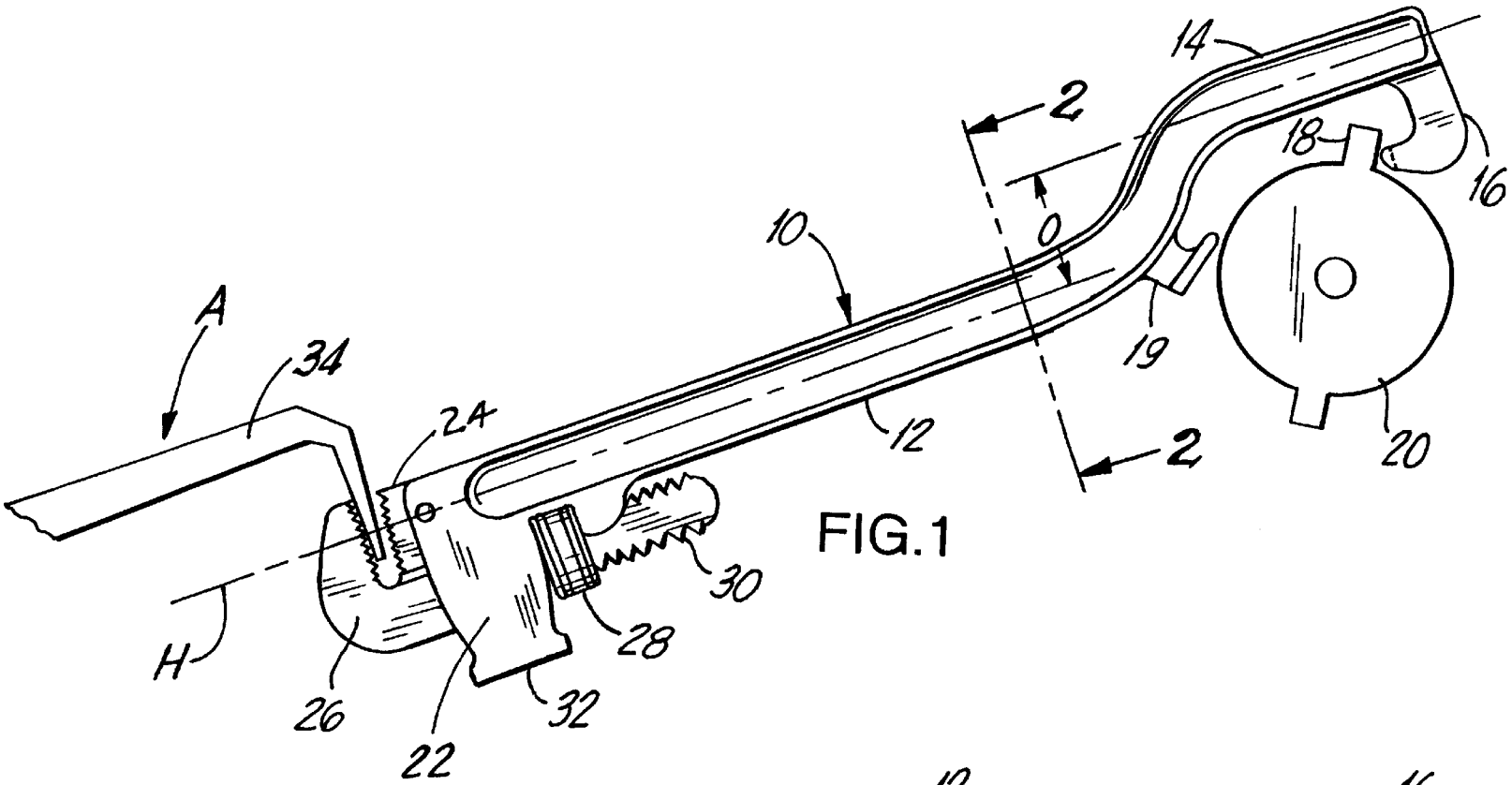
FIG. 1 is a view of the tool of the invention, showing a spanner part of the tool engaging a pipe cap, and a wrench part of the tool supporting an outside lever device to facilitate operation of the spanner part.

FIG. 1 is a view of a wrench tool 10 according to the invention. The tool 10 includes a tool handle 12 formed of a sturdy rigid material such as, for example, tool steel. A spanner part 14 is formed integrally at a first end of the tool handle 12, and has a determined offset O to one side of an axis H of the tool handle. A claw 16 projects from the free end of the spanner part 14, approximately perpendicular to the handle axis H, for operatively engaging a cylindrical pin 18 on a circumference of a pipe cap 20 or other object, e.g., a hose coupling ring, to be worked by the tool 10. The spanner part also has a foot 19 that projects toward and seats against the circumference of the object to be rotated by the tool, in cooperation with the claw 16.

Figure 2:
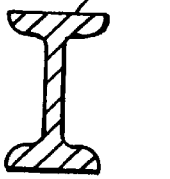
FIG. 2 is an enlarged sectional view of the tool taken along line 2—2 in FIG. 1.
Figure 3:
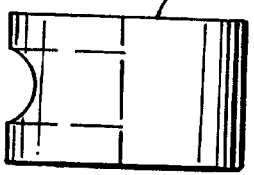
FIG. 3 is an enlarged top view of a claw at an end of the spanner part of the tool.

FIG. 2 is a cross-section of the tool handle 12, which typically may have an "I" shape. FIG. 3 is an enlarged top end view of the claw 16, which, like the spanner part 14, may be integrally formed of the same material as the tool handle 12.

The tool 10 also has a wrench part 22 at a second end of the tool handle 12, opposite the first end where the spanner part 14 is disposed. The wrench part 22 has a pair of confronting jaws 24, 26. One of the jaws, e.g., jaw 24 may be situated at a fixed end of the tool handle 12. Jaw 26 is constructed and arranged for adjustable sliding movement relative to the jaw 24, along the direction of the handle axis H. Movement of the jaw 26 may be adjusted by rotation of a thumb wheel 28 that engages threads 30 formed on a leg part of the jaw 26, wherein axial movement of the thumb wheel 28 is restrained by parts of the tool body as seen in FIG. 1.

The end of the tool handle 12 at which the jaw 24 is disposed, may also form a hammerhead 32 to allow the wrench part 22 of the tool to be used as a hammer when appropriate. In other respects, the wrench part 22 may be the same or similar to the head of a conventional adjustable pipe wrench.

The range of movement of the jaw 26 relative to the jaw 24 is such that the jaws can be set (by operation of thumb wheel 28) to receive and safely support an end of an outside levering tool such as a pry bar 34, for obtaining increased leverage when operating the spanner part 14 of the tool 10. For example, if the spanner part 14 is working to unscrew the pipe cap 20 in a counter-clockwise direction in FIG. 1, a force applied on the pry bar 34 in the direction of arrow A in FIG. 1 will allow greater torque to be exerted on the pipe cap 20 than might otherwise be obtained by pushing downward on the tool handle 12.

As shown in FIG. 1, the jaws 24, 26 at the wrench part 22 open in a direction that faces opposite the direction in which the claw 16 protrudes from the spanner part 14. Thus, when a force is applied to the pry bar 34, the end of the bar will be urged further within the jaws 24, 26 to engage the tool 10 safely while transmitting torque to the spanner part 14.

The present tool 10 therefore provides not only the convenience of both a spanner and an adjustable wrench in a single tool, but readily cooperates with outside tools such as the pry bar 34 to cause the spanner part 14 to exert increased leverage when encountering a difficult or "stubborn" pipe cap or hose coupling. In addition, the wrench part 22 may be used to grip and rotate a wheel of a frozen standpipe valve stem, or, if such wheel is missing, to grip and turn the valve stem directly.

While the foregoing description represents a preferred embodiment of the invention, it will be obvious to those skilled in the art that various changes and modifications may be made, without departing from the spirit and scope of the invention pointed out by the following claims.

I claim:

1. A wrench tool, comprising:

an elongated tool handle having a handle axis, a first end, and a second end opposite the first end;

the first end of the tool handle forms a spanner including a claw that projects in a first direction normal to the handle axis, and the claw and the first end of the tool handle are arranged to cooperate to engage a circumference of a generally circular object to be rotated by the tool; and the second end of the tool handle forms a first wrench jaw, and a second wrench jaw is mounted at the second end of the tool handle wherein the second wrench jaw is constructed and arranged for adjustable sliding movement relative to the first wrench jaw along the direction of the handle axis over a certain range, so that the first and the second wrench jaws cooperate to engage an object to be worked by the tool;

wherein the range of movement of the first and the second wrench jaws includes a position at which the jaws are set to receive and grip an end of an outside levering tool so that the outside levering tool and said tool handle together can transmit increased leverage for operating the spanner at the first end of the tool handle; and wherein the first and the second wrench jaws are arranged to receive the end of the outside levering tool from a second direction that is normal to the handle axis and opposite to the first direction in which the claw of the spanner projects, so that a force applied to the outside levering tool when transmitting the increased leverage to operate the spanner, acts to maintain the end of the levering tool within the wrench jaws.

2. A wrench tool according to claim 1, wherein the second end of the tool handle forms a hammerhead.

3. A wrench tool according to claim 1, wherein the second wrench jaw has a threaded leg part, and including a thumb wheel mounted at the second end of the tool handle for engaging the leg part and for adjusting the sliding movement of the second wrench jaw relative to the first wrench jaw in the direction of the axis of the tool handle.

* * * * *